US008844486B2

(12) United States Patent
Hayashi et al.

(10) Patent No.: US 8,844,486 B2
(45) Date of Patent: Sep. 30, 2014

(54) VALVE TIMING CONTROL APPARATUS

(71) Applicant: Denso Corporation, Kariya (JP)

(72) Inventors: Masashi Hayashi, Okazaki (JP); Tomonobu Ikuma, Kariya (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 14/093,620

(22) Filed: Dec. 2, 2013

(65) Prior Publication Data

US 2014/0150741 A1 Jun. 5, 2014

(30) Foreign Application Priority Data

Nov. 30, 2012 (JP) ..... 2012-262274

(51) Int. Cl.
*F01L 1/34* (2006.01)
*F01L 1/344* (2006.01)

(52) U.S. Cl.
CPC ..... *F01L 1/3442* (2013.01)
USPC ..... 123/90.17; 123/90.15; 464/160

(58) Field of Classification Search
USPC ..... 123/90.15, 90.17; 464/160
See application file for complete search history.

(56) References Cited

U.S. PATENT DOCUMENTS 8,286,602 B2 * 10/2012 Kameda et al. ..... 123/90.17
2012/0097122 A1 4/2012 Lichti

* cited by examiner

*Primary Examiner* — Ching Chang
(74) *Attorney, Agent, or Firm* — Nixon & Vanderhye PC

(57) ABSTRACT

In a valve timing control apparatus, a supply oil passage, which supplies hydraulic oil to advancing chambers, is formed separately from a discharge oil passage, which discharges the hydraulic oil from the advancing chambers. A spool is configured to reciprocate in a sleeve to enable and disable communication between each corresponding two of an intake oil passage, the supply oil passage, the discharge passage, and a supply and discharge passage. An isolating member is fixed to one end portion of the spool and isolates an air chamber, which is formed between the one end portion of the spool and a bottom portion of the sleeve, from each of the oil passages.

4 Claims, 11 Drawing Sheets

VALVE TIMING CONTROL APPARATUS

CROSS REFERENCE TO RELATED APPLICATION

This application is based on and incorporates herein by reference Japanese Patent Application No. 2012-262274 filed on Nov. 30, 2012.

TECHNICAL FIELD

The present disclosure relates to a valve timing control apparatus.

BACKGROUND

There is known a valve timing control apparatus that controls, i.e., adjusts opening timing and closing timing of intake valves or exhaust valves, which are driven by a driven-side shaft of an internal combustion engine, by changing a rotational phase between a driving-side shaft and the driven-side shaft of the internal combustion engine. In this type of valve timing control apparatus, a pressure of hydraulic oil in advancing chambers and a pressure of hydraulic oil in retarding chambers are changed in the housing, so that the vane rotor is rotated relative to the housing to change the opening timing and closing timing of the valves.

For example, a valve timing control apparatus recited in US2012/0097122A1 includes a hydraulic pressure control valve, which controls a hydraulic pressure of hydraulic oil in advancing chambers and a hydraulic pressure of hydraulic oil in retarding chambers. In this hydraulic pressure control valve, depending on an operational position of a spool, the hydraulic oil is discharged from the retarding chambers while supplying the hydraulic oil to the advancing chambers, or the hydraulic oil is discharged from the advancing chambers while supplying the hydraulic oil to the retarding chambers. An end surface of the spool forms a part of a discharge oil passage, through which the hydraulic oil is discharged from the advancing chambers.

In the valve timing control apparatus of US2012/0097122A1, a pressure of the hydraulic oil, which is discharged from the advancing chambers, is applied to the end surface of the spool of the hydraulic pressure control valve. According to a result of a study of the inventors of the present patent application, it is found that positioning accuracy of the spool is deteriorated when the pressure of the hydraulic oil is applied to the end surface of the spool. This disadvantage of deteriorating the positioning accuracy of the spool also occurs in a case where the pressure of the hydraulic oil, which is supplied to the advancing chambers or the retarding chambers, is applied to the end surface of the spool.

SUMMARY

The present disclosure addresses the above disadvantage.

According to the present disclosure, there is provided a valve timing control apparatus that controls opening timing and closing timing of one of an intake valve and an exhaust valve of an internal combustion engine, which is driven by a driven-side shaft that is, in turn, driven by a driving-side shaft at the internal combustion engine. The valve timing control apparatus controls the opening timing and closing timing of the one of the intake valve and the exhaust valve through changing of a rotational phase between the driving-side shaft and the driven-side shaft. The valve timing control apparatus includes a housing, a boss, a vane, a sleeve, an intake oil passage, a supply oil passage, a discharge oil passage, a supply and discharge oil passage, a spool, and an isolator. The housing is rotatable integrally with one of the driving-side shaft and the driven-side shaft. The boss is placed in the housing and is configured into a tubular form. The boss is rotatable integrally with the other one of the driving-side shaft and the driven-side shaft. The vane radially extends from the boss and partitions a hydraulic pressure chamber, which is formed between the housing and the boss, into a first chamber and a second chamber. The vane is rotatable together with the boss in an advancing direction or a retarding direction relative to the housing in response to a pressure of hydraulic oil in the first chamber and a pressure of the hydraulic oil in the second chamber. The sleeve is configured into a bottomed tubular body and is fitted to an inner peripheral surface of the boss. The intake oil passage radially extends through a tubular portion of the sleeve and guides the hydraulic oil from an outside into an inside of the sleeve. The supply oil passage radially extends through the tubular portion of the sleeve and is communicated with the first chamber through the boss to guide the hydraulic oil from the inside of the sleeve to the first chamber. The discharge oil passage radially extends through the tubular portion of the sleeve and is communicated with the first chamber through the boss to guide the hydraulic oil from the first chamber to the inside of the sleeve. The supply and discharge oil passage radially extends through the tubular portion of the sleeve and is communicated with the second chamber through the boss to conduct the hydraulic oil between the inside of the sleeve and the second chamber. The spool is configured to reciprocate in an axial direction in the sleeve. The spool enables and disables communication between each corresponding two of the intake oil passage, the supply oil passage, the discharge oil passage and the supply and discharge oil passage depending on an axial position of the spool. The isolator is fixed to one end portion of the spool, which is located on a side where a bottom portion of the sleeve is placed. The isolator isolates a space, which is formed between the one end portion of the spool and the bottom portion of the sleeve, from the intake oil passage, the supply oil passage, the discharge oil passage, and the supply and discharge oil passage.

BRIEF DESCRIPTION OF THE DRAWINGS

The drawings described herein are for illustration purposes only and are not intended to limit the scope of the present disclosure in any way.

DETAILED DESCRIPTION

Figure 1:
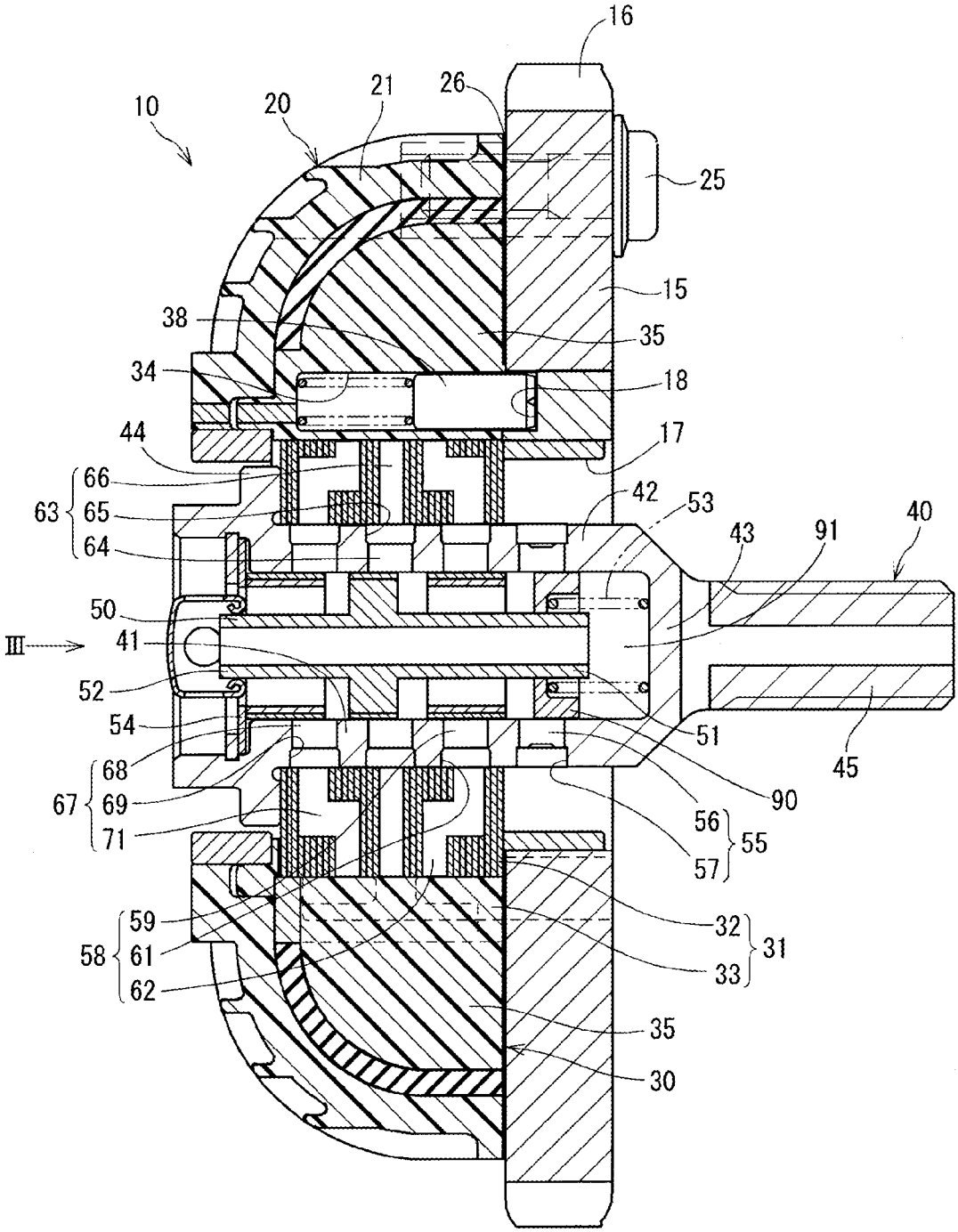
FIG. 1 is a longitudinal cross-sectional view of a valve timing control apparatus according to a first embodiment of the present disclosure.

Various embodiments of the present disclosure will be described with reference to the accompanying drawings. In the following discussion of the embodiments, similar components will be indicated by the same reference numerals and will not be described redundantly for the sake of simplicity.

First Embodiment

Figure 2:
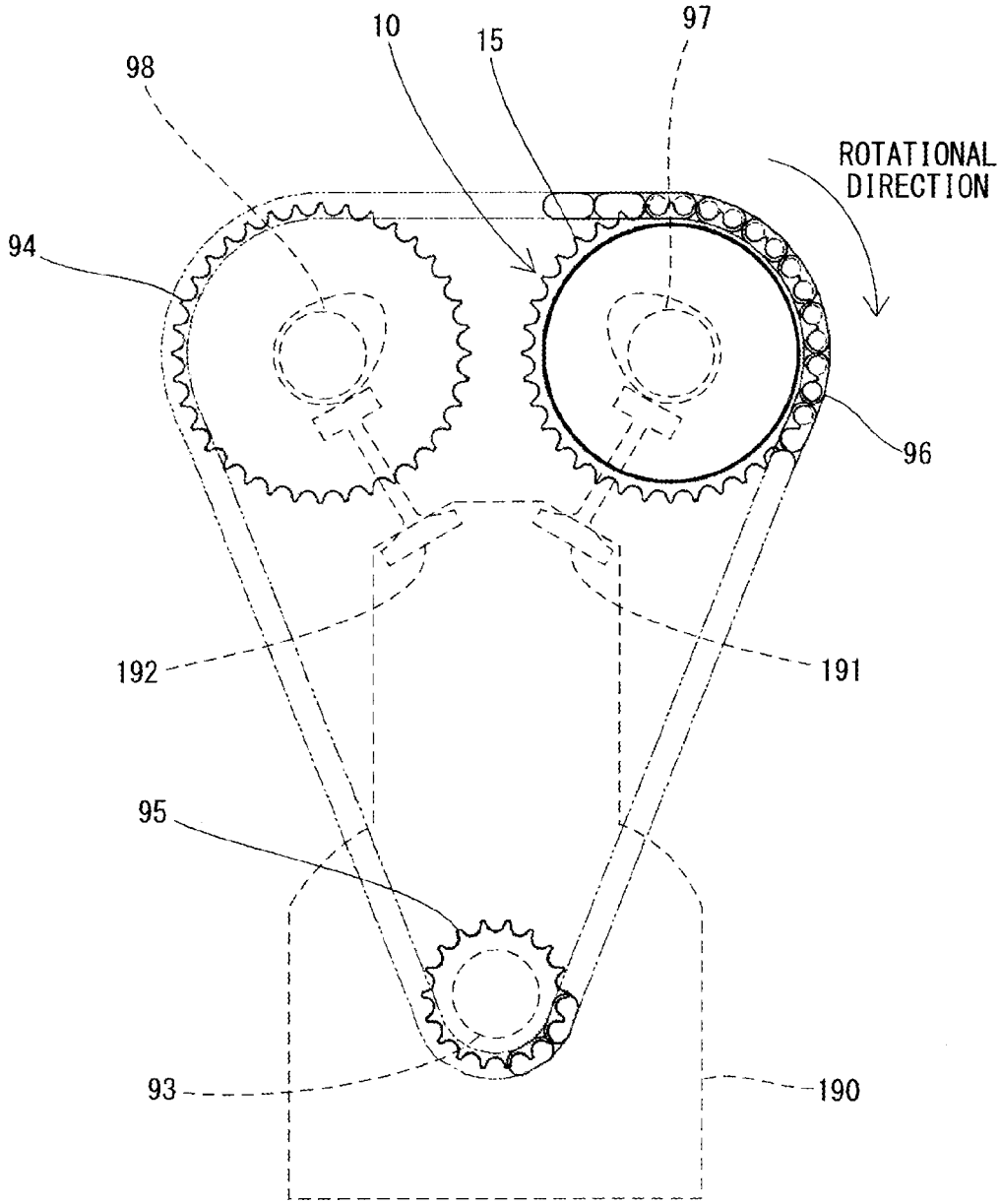
FIG. 2 is a schematic diagram showing an internal combustion engine, to which the valve timing control apparatus of FIG. 1 is applied.

FIG. 1 shows a valve timing control apparatus according to a first embodiment of the present disclosure. The valve timing control apparatus 10 controls, i.e., adjusts opening timing and closing timing of intake valves 191 of an internal combustion engine 190 shown in FIG. 2. As shown in FIG. 2, rotation of a crankshaft 93, which is a driving-side shaft of the engine 190, is transmitted to two camshafts 97, 98 through a chain 96, which is wound around three sprockets 15, 94, 95, to drive the camshafts 97, 98. The camshaft 97 is a driven-side shaft, which drives the intake valves 191 to open and close the same. The camshaft 98 is a driven-side shaft, which drives the exhaust valves 192 to open and close the same.

The valve timing control apparatus 10 advances the opening timing and closing timing of the intake valves 191 by rotating the camshaft 97 in a forward rotational direction relative to the sprocket 15, which rotates integrally with the crankshaft 93. This relative rotation of the camshaft 97, which shifts the opening timing and closing timing of the intake valves 191 forward, will be referred to as "advancing."

In contrast, when the camshaft 97 is rotated in an opposite rotational direction, which is opposite from the forward rotational direction, relative to the sprocket 15, the opening timing and closing timing of the intake valves 191 is shifted backward. This relative rotation of the camshaft 97, which shifts the opening timing and closing timing of the intake valves 191 backward, will be referred to as "retarding."

Figure 3:
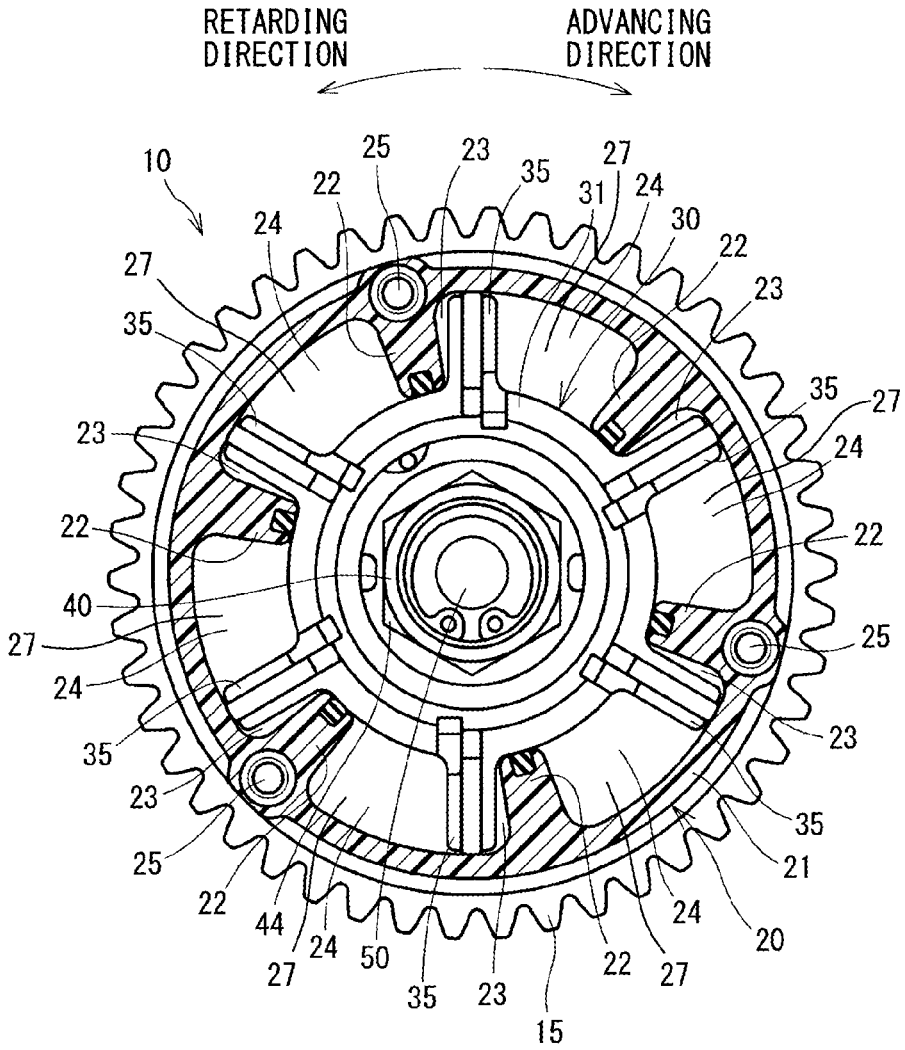
FIG. 3 is a view of the valve timing control apparatus taken in a direction of an arrow III in FIG. 1 while cutting a part of an outer shell of a housing of the valve timing control apparatus for illustrative purpose.

First of all, the structure of the valve timing control apparatus 10 will be schematically described with reference to FIGS. 1 to 3. The valve timing control apparatus 10 includes the sprocket 15, a housing 20, a vane rotor 30, a lock pin 38, a sleeve bolt 40 and a spool 50.

The sprocket 15 has external teeth 16 and a through-hole 17. The chain 96 of FIG. 2 is wound around the external teeth 16. The camshaft 97 of FIG. 2 is received through the through-hole 17.

The housing 20 has an outer shell 21 and a plurality of partition walls 22. The outer shell 21 is configured into a dome shape and is fixed to the sprocket 15 through an outer peripheral portion of the outer shell 21 by bolts 25. A seal plate 26 is clamped between the housing 20 and the sprocket 15. The partition walls 22 radially inwardly extend from the outer shell 21 to partition the inside of the outer shell 21 into a plurality of hydraulic pressure chambers 27.

The vane rotor 30 forms a boss 31 and a plurality of vanes 35. The boss 31 is configured into a tubular form and is placed on a radially inner side of the partition walls 22 such that the boss 31 is coaxial with a rotational axis of the vane rotor 30. In the present embodiment, the boss 31 includes a laminated body 32 and a tubular portion 33. The laminated body 32 includes a plurality of metal plates, which are stacked one after another in a thickness direction of the respective metal plates. The tubular portion 33 is made of a resin material and is molded to an outer peripheral part of the laminated body 32. The boss 31 is fixed to the camshaft 97 of FIG. 2 with the sleeve bolt 40 and is rotatable integrally with the camshaft 97.

Each vane 35 radially extends from the boss 31 and partitions the corresponding hydraulic pressure chamber 27, which is circumferentially defined between corresponding two of the partition walls 22 at a radial location between the housing 20 and the boss 31, into an advancing chamber 23 and a retarding chamber 24. The advancing chamber 23 serves as a first chamber of the present disclosure, and the retarding chamber 24 serves as a second chamber of the present disclosure. The vane rotor 30 is rotatable relative to the housing 20 in an advancing direction (advancing side) or a retarding direction (retarding side) shown in FIG. 3 in response to the pressure of the hydraulic oil supplied to the advancing chambers 23 and the pressure of the hydraulic oil supplied to the retarding chambers 24.

The tubular portion 33 of the boss 31 has a slide hole 34, which slidably supports the lock pin 38 in the axial direction. The lock pin 38 is insertable and removable relative to a fitting hole 18 of the sprocket 15. When the lock pin 38 is inserted into the fitting hole 18, the relative rotation between the vane rotor 30 and the housing 20 is limited.

The sleeve bolt 40 has a sleeve 41 and a threaded portion 45. The sleeve 41 is configured into a bottomed tubular body, which is defined as a tubular body having a bottom portion at one end thereof. The sleeve 41 is coaxial with the rotational axis and is fitted into an inner peripheral surface of the boss 31 of the vane rotor 30. The bottom portion 43 of the sleeve 41 is formed integrally at an end part of the tubular portion 42, which is axially located on the side where the sprocket 15 is placed. An opposite part of the tubular portion 42, which is axially opposite from the bottom portion 43, forms a head 44. The threaded portion 45 extends from the bottom portion 43 of the sleeve 41 in the axial direction away from the head 44. The sleeve bolt 40 fixes the vane rotor 30 to the camshaft 97 shown in FIG. 2.

The spool 50 can reciprocate in the axial direction in the inside of the sleeve 41. One end portion 51 of the spool 50, which is axially located on a side where the bottom portion 43 of the sleeve 41 is located, is axially urged toward a stopper plate 54 located adjacent to the head 44 by a spring 53. The other end portion 52 of the spool 50, which is axially opposite from the one end portion 51, is configured to be axially urged against the urging force of the spring 53 by a linear solenoid (not shown), which is axially placed on an opposite side of the spool 50 that is opposite from the spring 53. The axial position of the spool 50 is determined by a balance between the urging force of the spring 53 and the urging force of the linear solenoid.

The sleeve 41 and the spool 50 cooperate with each other to form a hydraulic pressure control valve, which controls the pressure of the hydraulic oil in the advancing chambers 23 and the pressure of the hydraulic oil in the retarding chambers 24. Depending the axial position of the spool 50, the hydraulic pressure control valve supplies the hydraulic oil to the advancing chambers 23 while discharging the hydraulic oil from the retarding chambers 24 or supplies the hydraulic oil to the retarding chambers 24 while discharging the hydraulic oil from the advancing chambers 23.

In the valve timing control apparatus 10, which is constructed in the above-described manner, in the case where the rotational phase is on the retarding side of the target value, the hydraulic oil is supplied to the advancing chambers 23, and at the same time, the hydraulic oil is discharged from the retarding chambers 24. Thereby, the vane rotor 30 is rotated in the advancing direction relative to the housing 20.

Furthermore, in the case where the rotational phase is on the advancing side of the target value, the hydraulic oil is supplied to the retarding chambers 24, and at the same time, the hydraulic oil is discharged from the advancing chambers 23. Thereby, the vane rotor 30 is rotated in the retarding direction relative to the housing 20.

Furthermore, in the case where the rotational phase coincides with the target value, the advancing chambers 23 and the retarding chambers 24 are closed, so that the rotational phase of the vane rotor 30 is maintained.

Next, the characteristic features of the valve timing control apparatus 10 will be described with reference to FIGS. 1 and 3 to 10.

The vane rotor 30 includes an intake oil passage 55, a supply oil passage 58, a discharge oil passage 67, and a supply and discharge oil passage 63. The intake oil passage 55 includes a plurality of through-holes 56 and an annular groove 57. Each through-hole 56 radially extends through a corresponding part of the tubular portion 42 of the sleeve 41, which is placed at a corresponding axial location that coincides with an axial location of the sprocket 15. The annular groove 57 circumferentially extends along this part of the tubular portion 42 at an axial location, which coincides with an axial location of the through-holes 56. The intake oil passage 55 guides the hydraulic oil, which is pumped from an outside, more specifically, an undepicted oil pan by an undepicted oil pump, to the inside of the sleeve 41. The oil pan may serves as a hydraulic oil source.

The supply oil passage 58 includes a plurality of through-holes 59, an annular groove 61 and a plurality of passages 62. Each through-hole 59 radially extends through a corresponding part of the tubular portion 42 of the sleeve 41, which is axially adjacent to the through-holes 56 and is axially located on one side of the through-holes 56 where the head 44 is placed. The annular groove 61 circumferentially extends along this part of the tubular portion 42 at an axial location, which coincides with an axial location of the through-hole 59. The passages 62 connect the through-holes 59 to the advancing chambers 23, respectively, through the boss 31. The supply oil passage 58 guides the hydraulic oil, which is supplied from the inside of the sleeve 41, to the advancing chambers 23.

The supply and discharge oil passage 63 includes a plurality of through-holes 64, an annular groove 65 and a plurality of passages 66. Each through-hole 64 radially extends through a corresponding part of the tubular portion 42 of the sleeve 41, which is axially adjacent to the through-holes 59 and is axially located on the side of the through-holes 59 where the head 44 is placed. The annular groove 65 circumferentially extends along this part of the tubular portion 42 at an axial location, which coincides with an axial location of the through-holes 64. The passages 66 connect the through-holes 64 to the retarding chambers 24, respectively, through the boss 31. The supply and discharge oil passage 63 guides the hydraulic oil, which is supplied from the inside of the sleeve 41, to the retarding chambers 24. Alternatively, the supply and discharge oil passage 63 guides the hydraulic oil, which is discharged from the retarding chambers 24, to the inside of the sleeve 41.

The discharge oil passage 67 includes a plurality of through-holes 68, an annular groove 69 and a plurality of passages 71. Each through-hole 68 radially extends through a corresponding part of the tubular portion 42 of the sleeve 41, which is axially adjacent to the through-holes 64 and is axially located on the side of the through-holes 64 where the head 44 is placed. The annular groove 69 circumferentially extends along this part of the tubular portion 42 at an axial location, which coincides with an axial location of the through-holes 68. The passages 71 connect the through-holes 68 to the advancing chambers 23, respectively, through the boss 31. The discharge oil passage 67 guides the hydraulic oil, which is discharged from the advancing chambers 23, to the inside of the sleeve 41.

An inner diameter of each through-hole 56, an inner diameter of each through-hole 59, an inner diameter of each through-hole 64 and an inner diameter of each through-hole 68 are generally equal to each other. Furthermore, in the present embodiment, the number of the through-holes 56 is two, and the number of the through-holes 59 is two. Also, the number of the through-holes 64 is two. In contrast, the number of the through-holes 68 is four.

In the present embodiment, each of the number of the passages 62, the number of the passages 66, and the number of the passages 71 coincides with the number of the hydraulic pressure chambers 27 and is thereby six. Furthermore, a passage cross-sectional area of each passage 71 is larger than a passage cross-sectional area of each passage 62 and a passage cross-sectional area of each passage 66.

In the present embodiment, a passage cross-sectional area of the discharge oil passage 67 is set to be larger than a passage cross-sectional area of the intake oil passage 55, a passage cross-sectional area of the supply oil passage 58 and a passage cross-sectional area of the supply and discharge oil passage 63.

Figure 4:
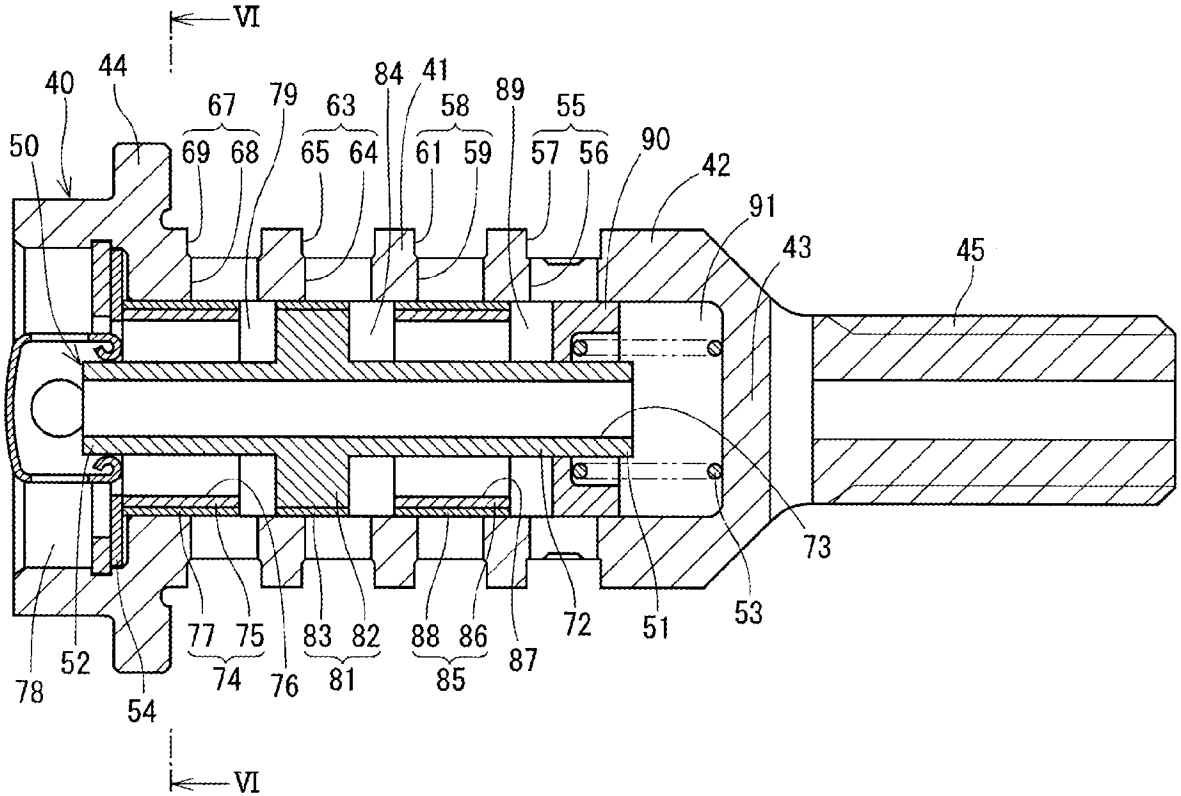
FIG. 4 is a cross-sectional view of a sleeve bolt and a spool of the valve timing control apparatus shown in FIG. 1.
Figure 5:
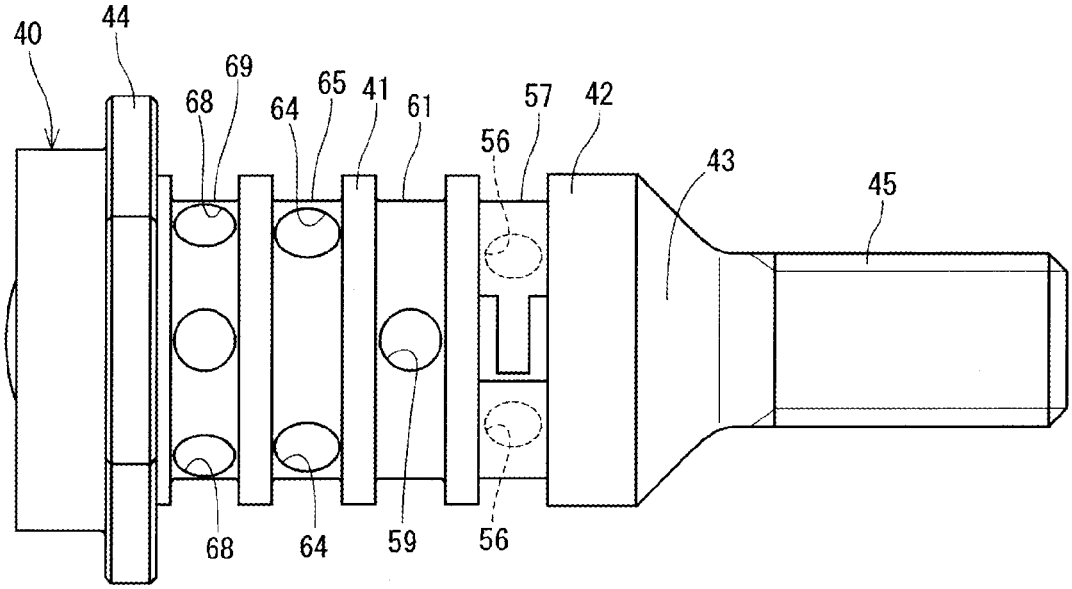
FIG. 5 is a side view of the sleeve bolt of the valve timing control apparatus shown in FIG. 1.
Figure 6:
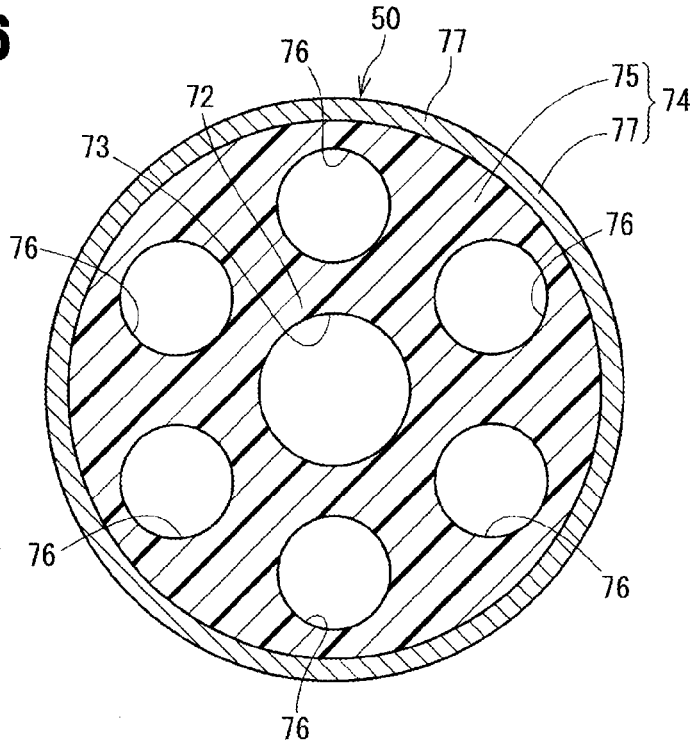
FIG. 6 is a cross-sectional view of the spool along line VI-VI in FIG. 4.

As shown in FIG. 4, the spool 50 includes a shaft 72, a first partition 74, a second partition 81 and a third partition 85.

The shaft 72 is made of a resin material and is configured into a cylindrical tubular form, and the shaft 72 is coaxial with the rotational axis. The shaft 72 has an air communication hole 73, which extends through the shaft 72 in the direction of the rotational axis.

The first partition 74 includes a first flange 75 and a metal ring 77. The first flange 75 is formed integrally with the shaft 72 from the resin material. The metal ring 77 is securely fitted to an outer peripheral surface of the first flange 75. The first flange 75 includes a plurality of oil communication holes 76, which extend through the first flange 75 in the axial direction. In the present embodiment, the number of the oil communication holes 76 is six. Each oil communication hole 76 has a circular cross section. The oil communication holes 76 communicate between a drain space 78, which is communicated with the outside (i.e., the oil pan), and a space 79, which is formed between the first partition 74 and the second partition 81.

The second partition 81 includes a second flange 82 and a metal ring 83. The second flange 82 is formed integrally with the shaft 72 from the resin material. The metal ring 83 is securely fitted to an outer peripheral surface of the second flange 82. The second flange 82 separates, i.e., isolates the space 79 from a space 84, which is formed between the second partition 81 and the third partition 85.

The third partition 85 includes a third flange 86 and a metal ring 88. The third flange 86 is formed integrally with the shaft 72 from the resin material. The metal ring 88 is securely fitted to an outer peripheral surface of the third flange 86. The third flange 86 includes a plurality of oil communication holes 87, which extend through the third flange 86 in the axial direction. In the present embodiment, the number of the oil communication holes 87 is six. Each oil communication hole 87 has a circular cross section. The oil communication holes 87 communicate between the space 84 and a space 89, which is formed between the third partition 85 and an isolating member 90.

Each of the metal rings 77, 83, 88 is configured to sever, i.e., cut a foreign object, which would be otherwise clamped between the spool 50 and the sleeve 41. Thus, each of the metal rings 77, 83, 88 limits the clamping of the foreign object between the spool 50 and the sleeve 41.

The isolating member 90 is fixed to the one end portion 51 of the spool 50. The isolating member 90 serves as isolator (or an isolating means) of the present disclosure and isolates an air chamber 91, which is formed between the one end portion 51 of the spool 50 and the bottom portion 43 of the sleeve 41, from the space 89. That is, the air chamber 91 is separated, i.e., isolated from the respective oil passages 55, 58, 63, 67 by the isolating member 90. The air chamber 91 serves as a space of the present disclosure.

When the spool 50 is placed in an initial position shown in FIG. 4 in the axial direction, the spool 50 connects between the through-holes 56 and the through-holes 64 through the space 89, the oil communication holes 87 and the space 84. In this way, the intake oil passage 55 can supply the hydraulic oil to the retarding chambers 24 through the supply and discharge oil passage 63. Furthermore, in the initial position of the spool 50, the through-holes 68 are communicated with the drain space 78 through the space 79 and the oil communication holes 76 while closing the through-holes 59 with the third partition 85. In this way, the discharge oil passage 67 can discharge the hydraulic oil from the advancing chambers 23.

Figure 7:
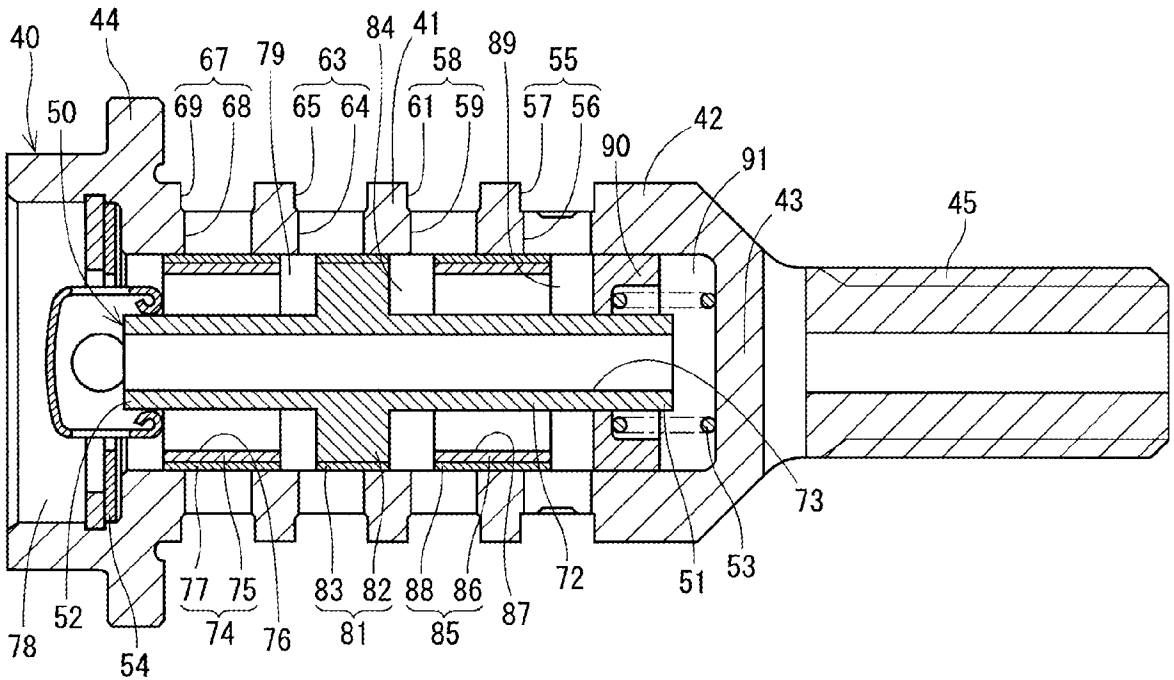
FIG. 7 is a cross-sectional view similar to FIG. 4, showing the spool positioned in a first operational position.

When the spool 50 is placed in a first operational position shown in FIG. 7 in the axial direction, the spool 50 connects between the through-holes 56 and the through-holes 59 through the space 89, the oil communication holes 87 and the space 84 while closing the through-holes 68 with the first partition 74. In this way, the intake oil passage 55 can supply the hydraulic oil to the advancing chambers 23 through the supply oil passage 58. Furthermore, in the first operational position of the spool 50, the spool 50 communicates between the through-holes 64 and the drain space 78 through the space 79 and the oil communication holes 76. In this way, the supply and discharge oil passage 63 can discharge the hydraulic oil from the retarding chambers 24.

Figure 8:
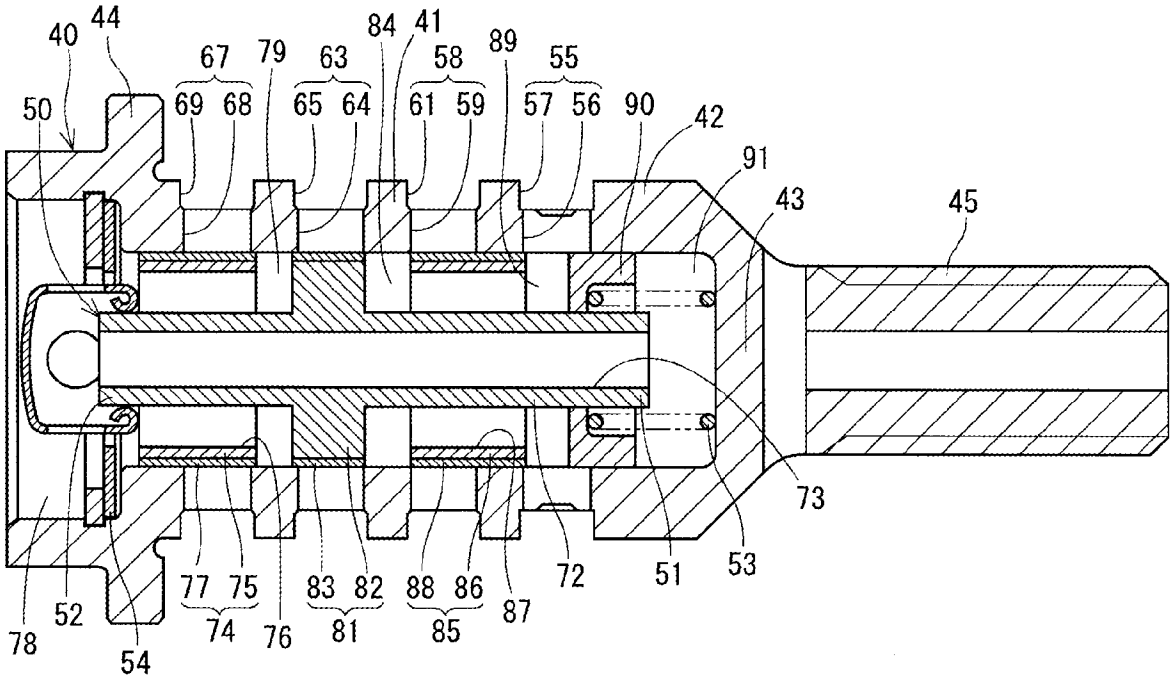
FIG. 8 is a cross-sectional view similar to FIG. 4, showing the spool positioned in a second operational position.

When the spool 50 is placed in a second operational position shown in FIG. 8 in the axial direction, the spool 50 closes the through-holes 68, the through-holes 64 and the through-holes 59 with the first partition 74, the second partition 81 and the third partition 85, respectively. In this way, the hydraulic oil in the advancing chambers 23 and the hydraulic oil in the retarding chambers 24 are maintained.

Figure 9:
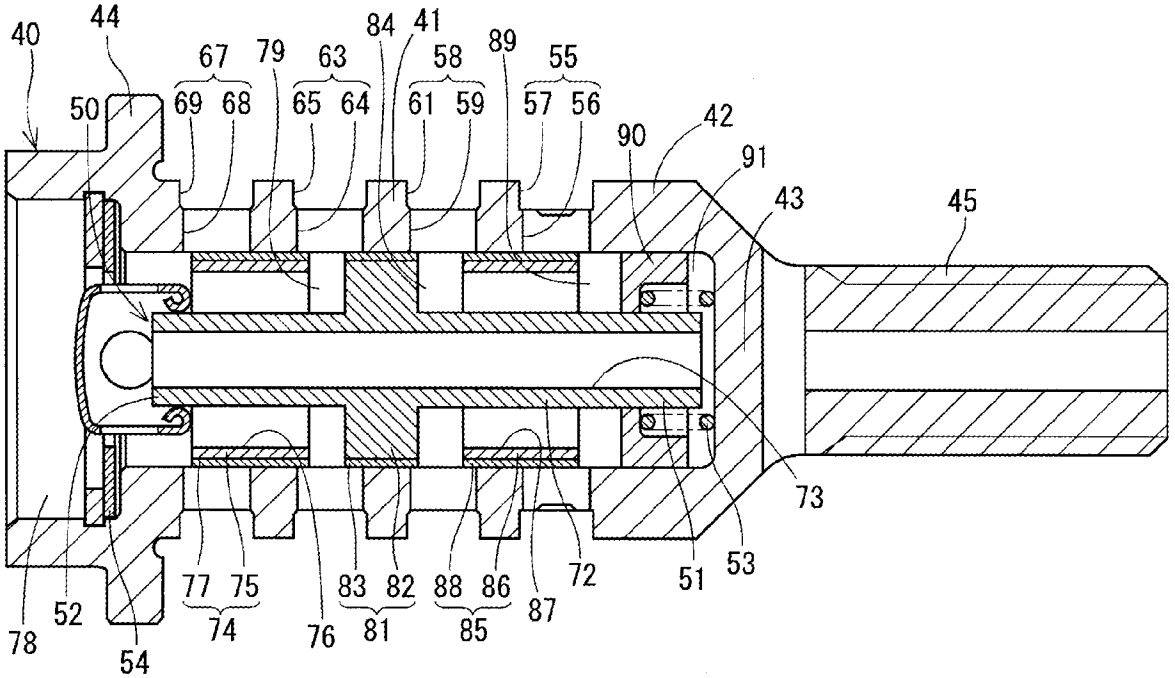
FIG. 9 is a cross-sectional view similar to FIG. 4, showing the spool positioned in a third operational position.

When the spool 50 is placed in a third operational position shown in FIG. 9 in the axial direction, the through-holes 56 are communicated with the through-holes 59 through the space 89 and the oil communication holes 87, and the through-holes 68 are communicated with the drain space 78. In this way, the intake oil passage 55 can supply the hydraulic oil to the advancing chambers 23 through the supply oil passage 58, and the discharge oil passage 67 can discharge the hydraulic oil from the advancing chambers 23. At this time, the advancing chambers 23 are cleaned with the hydraulic oil, which flows through the advancing chambers 23.

Figure 10:
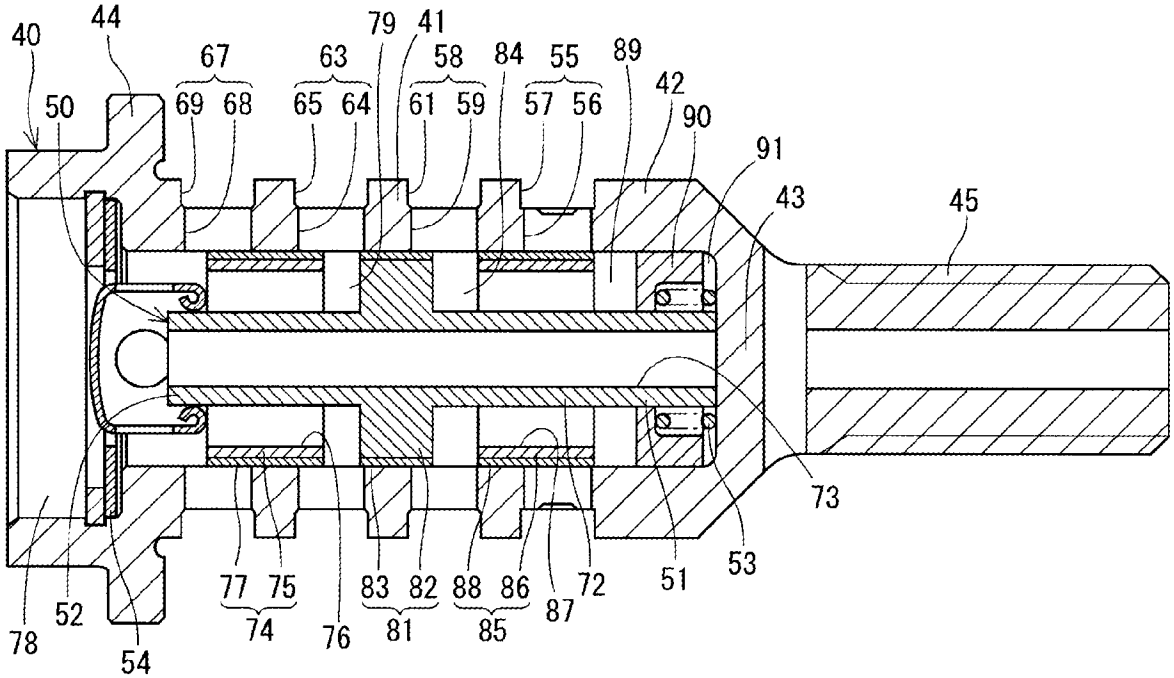
FIG. 10 is a cross-sectional view similar to FIG. 4, showing the spool positioned in a fourth operational position.

When the spool 50 is placed in a fourth operational position shown in FIG. 10 in the axial direction, the through-holes 56 are closed with the third partition 85, and the through-holes 68 are communicated with the drain space 78. Also, the through-holes 64 are communicated with the drain space 78 through the space 79 and the oil communication holes 76. In this way, the discharge oil passage 67 can discharge the hydraulic oil from the advancing chambers 23, and the supply and discharge oil passage 63 can discharge the hydraulic oil from the retarding chambers 24. In this way, the hydraulic oil can be discharged from both of the advancing chambers 23 and the retarding chambers 24.

In any of the operational positions of the spool 50, the air chamber 91 is isolated from the space 89 with the isolating member 90.

In contrast, in any of the operational positions of the spool 50, the air chamber 91 is communicated with the drain space 78 through the air communication hole 73 of the shaft 72 of the spool 50. In this way, when the spool 50 is moved to reduce the volume of the air chamber 91, the air of the air chamber 91 can be moved to the drain space 78 through the air communication hole 73. Furthermore, when the spool 50 is moved to reduce the volume of the air chamber 91, the air is introduced into the air chamber 91 through the air communication hole 73.

As discussed above, in the valve timing control apparatus 10 of the first embodiment, the isolating member 90 is fixed to the one end portion 51 of the spool 50, which is axially located on the side where the bottom portion 43 of the sleeve 41 is placed, and the air chamber 91, which is located between the one end portion 51 of the spool 50 and the bottom portion 43 of the sleeve 41, is isolated from the respective oil passages 55, 58, 63, 67. Therefore, the pressure of the hydraulic oil in each oil passage 55, 58, 63, 67 is not applied to the one end portion 51 of the spool 50. Thus, it is possible to avoid the deterioration of the positioning accuracy of the spool 50, which would be caused by the application of the pressure of the hydraulic oil to the one end portion 51 of the spool 50.

Furthermore, according to the first embodiment, the passage cross-sectional area of the discharge oil passage 67 is larger than the passage cross-sectional area of the supply oil passage 58. Therefore, the advancing speed and the retarding speed can be mechanically adjusted, and the control program can be simplified. Furthermore, at the time of staring the engine in the state where the lock pin 38 is removed from the fitting hole 18, and the surrounding temperature is extremely low, the hydraulic oil in the advancing chambers 23 can be rapidly discharged, and the rotational phase of the vane rotor 30 can be rapidly returned to a default phase, at which the engine start is possible, through use of a torque of a return spring.

Furthermore, according to the first embodiment, the spool 50 can be moved to the third operational position, at which the discharge oil passage 67 is communicated with the drain space 78 while communicating the intake oil passage 55 to the supply oil passage 58. Therefore, the advancing chambers 23 can be cleaned with the hydraulic oil through the discharging of the hydraulic oil, which is supplied from the outside to the intake oil passage 55 and is passed through the advancing chambers 23. This cleaning process of the advancing chambers 23 is executed in the state, which is before the normal control operation of the opening timing and closing timing of the intake valves 191 immediately after the starting of the engine, or in the state, in which the lock pin 38 is fitted into the fitting hole 18 during the normal control operation of the opening timing and closing timing of the intake valves 191.

Furthermore, according to the first embodiment, the spool 50 can be moved to the fourth operational position, at which the discharge oil passage 67 and the supply and discharge oil passage 63 are communicated with the drain space 78. In this fourth operational position, the vane rotor 30 is swung, so that the hydraulic oil can be rapidly discharged from both of the advancing chambers 23 and the retarding chambers 24. Particularly, when the spool 50 is moved to the fourth operational position at the time of restarting the engine after the time of determining the occurrence of the engine stall, the vane rotor 30 can be rapidly returned to the default phase. Thus, the required engine start time period can be reduced. Furthermore, in the case where the fitting position of the lock pin 38, at which the lock pin 38 is fitted into the fitting hole 18, is placed between the most advanced position and the most retarded position of the vane rotor 30, the amount of swing of the vane rotor 30 is increased, and thereby the fitting of the lock pin 38 into the fitting hole 18 at the time of restarting the engine is made possible.

Furthermore, according to the first embodiment, the shaft 72, the first flange 75, the second flange 82 and the third flange 86 of the spool 50 are made of the resin material. Therefore, the air communication hole 73, the oil communication holes 76 and the oil communication holes 87 can be easily formed.

Second Embodiment

Figure 11:
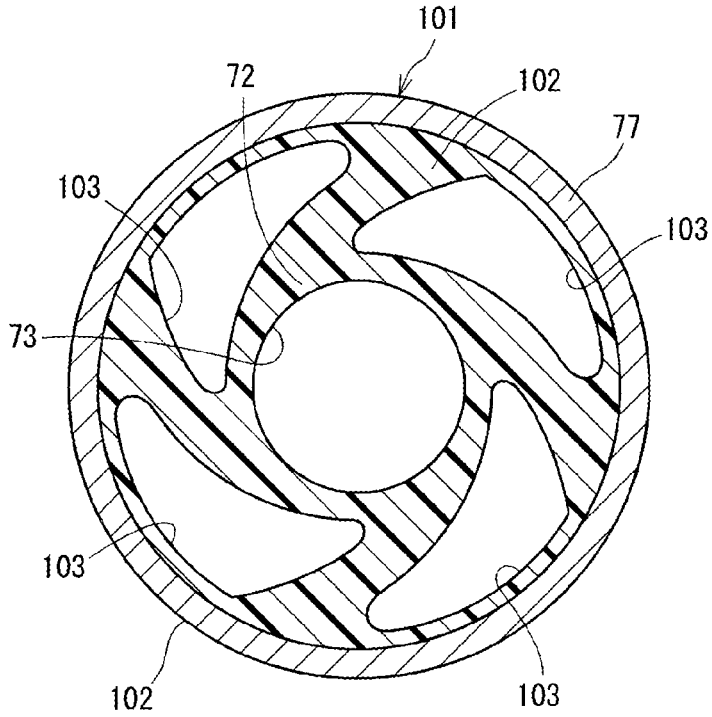
FIG. 11 is a cross-sectional view of a first partition of a spool of a valve timing control apparatus according to a second embodiment of the present disclosure.

A second embodiment of the present disclosure is a modification of the first embodiment. Therefore, in the following discussion, only the differences of the second embodiment, which differ from the first embodiment, will be described. Specifically, a spool of the valve timing control apparatus according to the second embodiment will be described with reference to FIG. 11. The shaft 72, the first flange 102, the second flange (not shown) and the third flange (not shown) of the spool 101 are made of the resin material, like in the first embodiment. The number of the oil communication holes 103 of the first flange 102 is four. Each oil communication hole 103 is configured to have a generally triangular cross-section. Each of the oil communication holes of the third flange is configured into the shape, which is similar to that of the oil communication hole 103.

According to the second embodiment, the first flange 102 and the third flange are made of the resin material. Therefore, the oil communication holes 103 of the first flange 102 and the oil communication holes of the third flange can be easily formed.

Third Embodiment

Figure 12:
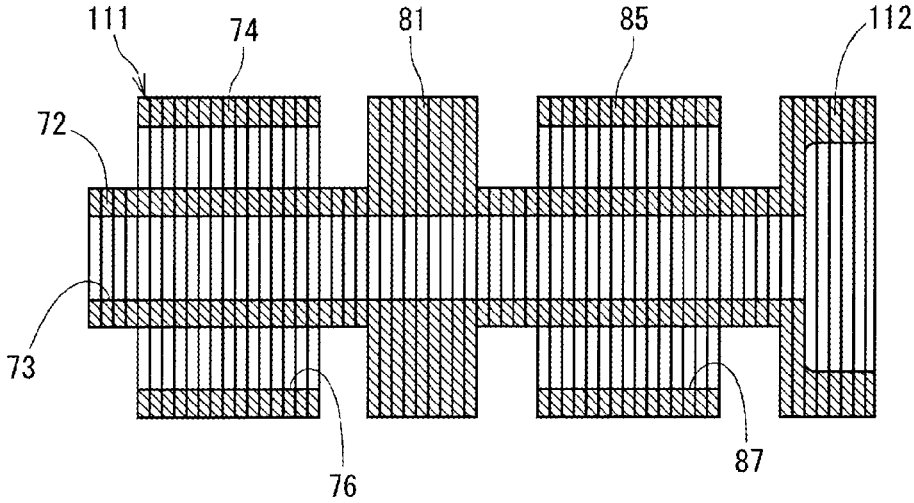
FIG. 12 is a longitudinal cross-sectional view of a spool of a valve timing control apparatus according to a third embodiment of the present disclosure.

A third embodiment of the present disclosure is a modification of the first embodiment. Therefore, in the following discussion, only the differences of the third embodiment, which differ from the first embodiment, will be described. Specifically, a spool and an isolating portion of the valve timing control apparatus according to the third embodiment will be described with reference to FIG. 12. The spool 111 and the isolating portion (serving as an isolator or an isolating means) 112 are formed as a laminated body, which includes a plurality of metal plates that are stacked one after another in a thickness direction of the respective metal plates (i.e., the axial direction or the longitudinal direction of the spool).

According to the third embodiment, the spool 111 and the isolating portion 112 can be easily integrally formed. Furthermore, even in a case where the shape of the oil communication holes 76 and the shape of the oil communication holes 87 are complicated to make the formation of these oil communication holes 76, 87 through the resin molding difficult, these oil communication holes can be easily formed in the present embodiment where the spool 111 is made of the laminated body.

Fourth Embodiment

Figure 13:
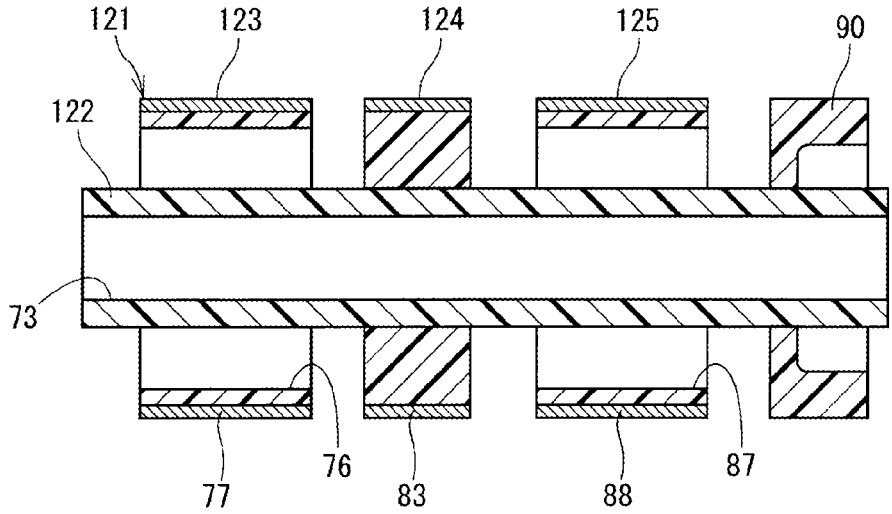
FIG. 13 is a longitudinal cross-sectional view of a spool of a valve timing control apparatus according to a fourth embodiment of the present disclosure.

A fourth embodiment is a modification of the first embodiment. Therefore, in the following discussion, only the differences of the fourth embodiment, which differ from the first embodiment, will be described. Specifically, a spool and the isolating member of the valve timing control apparatus according to the fourth embodiment will be described with reference to FIG. 13. The spool 121 includes the shaft 122, the first partition 123, the second partition 124 and the third partition 125. The first partition 123, the second partition 124 and the third partition 125 are formed through, for example, a press working process or the like and are thereafter press fitted to the shaft 122, which is configured into the cylindrical tubular form.

In the fourth embodiment, the spool 121 is formed by combining the multiple members, which are formed at the low manufacturing costs. Therefore, the spool 121 as well as the entire valve timing control apparatus can be formed at the low costs or reduced costs.

Now, modifications of the above embodiment(s) will be described.

In a modification of the above embodiment(s), the isolating member (the isolator or the isolating means) can be formed from the same member as that of the spool.

In another modification of the above embodiment(s), the passage cross-sectional area of the discharge oil passage may be the same as that of the supply oil passage. Furthermore, in the case where the passage cross-sectional area of the discharge oil passage is made larger than the passage cross-sectional area of the supply oil passage, the number of the corresponding through-holes of the spool, which form the discharge oil passage, may be set to be the same as the number of the corresponding through-holes of the spool, which form the supply oil passage while the passage cross-sectional area of each of the corresponding through-holes of the spool, which form the discharge oil passage, is set to be larger than the passage cross-sectional area of each of the corresponding through-holes of the spool, which form the supply oil passage.

In another modification of the above embodiment(s), the boss may not include the laminated body and may be entirely formed from the resin material.

In another modification of the above embodiment(s), the shape of the housing may be other than the dome shape. For example, the shape of the housing may be a tubular shape.

In another modification of the above embodiment(s), the rotation of the crankshaft of the engine may be transmitted to the housing through another type of drive force transmission member, which is other than the chain.

In another modification of the above embodiment(s), any other type of rotation transmission member, which is other than the sprocket, may be used.

In another modification of the above embodiment(s), the valve timing control apparatus may control the opening timing and closing timing of the exhaust valves of the engine in place of the intake valves.

The present disclosure is not limited the above embodiments and modifications thereof. That is, the above embodiments and modifications thereof may be further modified in various ways without departing from the principle of the present disclosure.

What is claimed is:

1. A valve timing control apparatus that controls opening timing and closing timing of one of an intake valve and an exhaust valve of an internal combustion engine, which is driven by a driven-side shaft that is, in turn, driven by a driving-side shaft at the internal combustion engine, through changing of a rotational phase between the driving-side shaft and the driven-side shaft, the valve timing control apparatus comprising:

a housing that is rotatable integrally with one of the driving-side shaft and the driven-side shaft;

a boss that is placed in the housing and is configured into a tubular form, wherein the boss is rotatable integrally with the other one of the driving-side shaft and the driven-side shaft;

a vane that radially extends from the boss and partitions a hydraulic pressure chamber, which is formed between the housing and the boss, into a first chamber and a second chamber, wherein the vane is rotatable together with the boss in an advancing direction or a retarding direction relative to the housing in response to a pressure of hydraulic oil in the first chamber and a pressure of the hydraulic oil in the second chamber;

a sleeve that is configured into a bottomed tubular body and is fitted to an inner peripheral surface of the boss;

an intake oil passage that radially extends through a tubular portion of the sleeve and guides the hydraulic oil from an outside into an inside of the sleeve;

a supply oil passage that radially extends through the tubular portion of the sleeve and is communicated with the first chamber through the boss to guide the hydraulic oil from the inside of the sleeve to the first chamber;

a discharge oil passage that radially extends through the tubular portion of the sleeve and is communicated with the first chamber through the boss to guide the hydraulic oil from the first chamber to the inside of the sleeve;

a supply and discharge oil passage that radially extends through the tubular portion of the sleeve and is communicated with the second chamber through the boss to conduct the hydraulic oil between the inside of the sleeve and the second chamber;

a spool that is configured to reciprocate in an axial direction in the sleeve, wherein the spool enables and disables communication between each corresponding two of the intake oil passage, the supply oil passage, the discharge oil passage and the supply and discharge oil passage depending on an axial position of the spool; and an isolator that is fixed to one end portion of the spool, which is located on a side where a bottom portion of the sleeve is placed, wherein the isolator isolates a space, which is formed between the one end portion of the spool and the bottom portion of the sleeve, from the intake oil passage, the supply oil passage, the discharge oil passage and the supply and discharge oil passage.

2. The valve timing control apparatus according to claim 1, wherein a passage cross-sectional area of the discharge oil passage is larger than a passage cross-sectional area of the supply oil passage.

3. The valve timing control apparatus according to claim 1, wherein the spool is movable to a position, at which the spool communicates the intake oil passage to the supply oil passage and communicates the discharge oil passage to the outside.

4. The valve timing control apparatus according to claim 1, wherein the spool is movable to a position, at which the spool communicates the discharge oil passage and the supply and discharge oil passage to the outside.

* * * * *